US009056386B2

(12) United States Patent
Kobayashi

(10) Patent No.: US 9,056,386 B2
(45) Date of Patent: Jun. 16, 2015

(54) METHOD OF SHOT-PEENING TREATMENT OF STEEL PRODUCT

(75) Inventor: Yuji Kobayashi, Toyokawa (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 434 days.

(21) Appl. No.: 13/498,453

(22) PCT Filed: Sep. 15, 2010

(86) PCT No.: PCT/JP2010/065952

§ 371 (c)(1),
(2), (4) Date: Mar. 27, 2012

(87) PCT Pub. No.: WO2011/040243

PCT Pub. Date: Apr. 7, 2011

(65) Prior Publication Data

US 2012/0180539 A1 Jul. 19, 2012

(30) Foreign Application Priority Data

Sep. 30, 2009 (JP) ..... 2009-227935

(51) Int. Cl.

| | |
|---|---|
| ***B24C 1/10*** | (2006.01) |
| ***B24C 1/08*** | (2006.01) |
| ***B24C 11/00*** | (2006.01) |

(Continued)

(52) U.S. Cl.

CPC . *B24C 1/10* (2013.01); *B24C 1/086* (2013.01); *B24C 11/00* (2013.01); *C21D 7/06* (2013.01); *C23C 8/80* (2013.01)

(58) Field of Classification Search

CPC ..... B24C 1/10; B24C 1/086; B21D 31/06; C21D 7/06

USPC ..... 72/53, 16.2, 17.3, 18.1; 29/90.7, 81.01, 29/81.09

See application file for complete search history.

(56) References Cited

U.S. PATENT DOCUMENTS

2009/0100658 A1* 4/2009 Kobayashi ..... 29/90.7

FOREIGN PATENT DOCUMENTS

| | | |
|---|---|---|
| JP | 04-64009 | 2/1992 |
| JP | 05-156351 | 6/1993 |

(Continued)

OTHER PUBLICATIONS

Masahiko Hibara, "Prolongation of Life of Die-casting Die," Nikkan Kogyo Shimbun, 2003, pp. 103-104.

(Continued)

*Primary Examiner* — Debra Sullivan

(74) *Attorney, Agent, or Firm* — Finnegan, Henderson, Farabow, Garrett & Dunner, L.L.P.

(57) ABSTRACT

The present invention aims to provide a method of shot-peening treatment that substantially improves the durability (particularly, heat check resistance) of the treated surface of the steel products in the process of treating by shot peening (hereafter, "SP") the surface of the steel product that is the work to be treated and that was treated by heat hardening.

The SP treatment of the present invention that gives the SP treatment to the steel product that was heat-treated and that is a work to be treated comprises the first SP treatment that removes the compound layer (white layer) and a second SP treatment that gives compressive residual stress to the first SP treated surface that was treated by the first SP treatment where the second SP treatment is carried out only to the products where it has been proved by the non-destructive inspection that the compound layers are removed by the first SP treatment.

6 Claims, 9 Drawing Sheets

(51) Int. Cl.
*C21D 7/06* (2006.01)
*C23C 8/80* (2006.01)

(56) References Cited

FOREIGN PATENT DOCUMENTS

| | | |
|---|---|---|
| JP | 10-217122 | 8/1998 |
| JP | 2002-166366 | 6/2002 |
| JP | 2003-191166 | 7/2003 |
| JP | 2005-203729 | 7/2005 |
| JP | 2005-294282 | 10/2005 |
| JP | 2006-131922 | 5/2006 |
| JP | 2007-056333 | 3/2007 |
| JP | 2008-195994 | 8/2008 |
| JP | 2009-076922 | 4/2009 |

OTHER PUBLICATIONS

Honda Motor Co Ltd and Rigaku Corp, "Inspecting Method for Compound Layer", English-language Abstract of JP 04-064009 (1992), (1 page).

Sintokogio Ltd and Sinto Brator Co Ltd, "Method for Improving Metal Mold Serviceable Life and Metal Mold", English-language Abstract of JP 2003-191166 (2003), (1 page).

Ebara Corp and Toshiba Corp, "Substrate Polishing Apparatus", English-language Abstract of JP 2005-203729 (2005), (1 page).

Texas Instruments Inc, "Surfactant for Post CMP Storage and Washing", English-language Abstract of JP 2005-294282 (2005), (1 page).

Toyota Motor Corp, "Method for Shot-Peening Nitrided Member, and Nitrided Member Treated with the Method", English-language Abstract of JP 2007-056333 (2007), (1 page).

Kyoto Institute for Technology, "Surface Modification Method for Titanium Product, and Surface Modified Titanium Product", English-language Abstract of JP 2008-195994 (2008), (1 page).

Applied Materials Inc, "Characterization of Wafer Edge by Seamless Radius Measurement", Englsh-language Abstract of JP 2009-076922 (2009), (1 page).

English-language International Search Report issued by the Japanese Patent Office in International Application No. PCT/JP2010/065952, mailed Dec. 28, 2010 (4 pages).

* cited by examiner (A)

(B)

(A)

(B)

Normal conditions (C)

Abnormal conditions

METHOD OF SHOT-PEENING TREATMENT OF STEEL PRODUCT

TECHNICAL FIELD

This invention relates to a method of a shot-peening treatment of steel product wherein a shot-peening (hereafter, "SP") is carried out on the steel product to give it a compressive residual stress, which product is a work to be treated that was first treated by heat hardening.

In one embodiment of the present invention, an example of a die (a steel product) that was treated by a nitride (nitriding), which is representative product used in heat hardenings, is explained. A die, particularly, a casting die for a light alloy (Al, Mg, etc.) is likely to be affected by small cracks (heat checks) after it is subjected to the repeated of heating and cooling when castings are produced. Thus the die is required to have a heat check resistance (a heat-resistant stress fatigue crack) and high accuracy on its shaped surface.

But the present invention can be applied to dies for forging (cold and hot). Further, naturally it can be applied to the steel product, such as a gear, spring, etc., that are required to have high durability.

"A Vickers hardness (HV)" used herein is based on JIS Z 2244.

The technical term "a shot-peening" includes a blasting treatment (cold processing method) that aims to "grind/polish" the work to be treated by injecting the particles to be injected (including grids and cut-wires) represented by shots, as in "a shot-peening," even if the shot-peening is not aimed to produce its original peening effect.

BACKGROUND

As above, conventionally to prevent heat-resistant stress fatigue crack (heat-crack) of a die (steel product) as much as possible, to treat the die by an SP treatment and give the die a compressive residual stress is well known (e.g., see Patent Documents 1 and 2).

Patent Document 1 discloses carrying out a plurality of shot-peening treatments of the die (a steel product) that was heat-treated, by injecting spherical particles (shots) having different hardness and different diameters, by suitably changing the hardness or the diameters of the particles (claim 3, etc.).

Patent Document 2 discloses using amorphous particles to be injected (shots) having a great hardness and a low Young's modulus in the shot-peening treatment of Patent document 1 (claim 3, etc.).

However, the dies in Patent Documents 1 and 2 are those used in forging or pressing (Paragraph 0001 of Patent document 1, and Paragraph 0002 of Patent document 2), and they are not intended for a casting die, which is the product that the present invention can be most suitably applied to. Further, neither Patent Documents 1 nor 2 discloses nor suggests carrying out the SP treatment that gives compressive residual stress, after removing a layer of chemical compounds (layer of high carbides) that are produced by a heat treatment (heat hardening treatment).

Patent documents 3-5 disclose technologies to remove an anomalous surface layer (white layer or a compound layer) of a coil or spring that is a steel product and that was treated by a nitride prior to SP treatment, although the technologies do not concern the SP treatment that treats the shaped surface of the die. In these Patent documents, removing the anomalous surface layer is carried out to increase the effect of the SP treatment that gives compressive residual stress.

Patent document 3 discloses a process of manufacturing a coil spring that is treated by the SP treatment after the white layer of a coil product, which white layer is generated by a nitride treatment, is removed by an electrolytic treatment (claim 1, etc.).

The technology to remove the white layer (compound layer) that is disclosed in Patent document 3 is different from the technology of the present invention and it is not directed to a technology to remove the white layer (compound layer) by shots.

Patent document 4 discloses a technology of shot-peening a gear after the white layer is removed by injecting particles of great hardness (shots), which particles have angular shapes, against the bottom of and dedendum of the gear that was treated by a heat treatment that includes a nitride treatment (claim 1, etc.). This patent document does not disclose any improved durability by removing of the layer that is treated by a nitride.

Patent document 5 discloses a technology wherein a diffusion layer of nitrogen is exposed on the gear tooth surface after the compound layer is removed by injecting hard particles that have a hardness of 100 or more in a Vicker's hardness test, against the gear tooth surface made of steel (steel product) that is nitride-treated (claims).

The technology to remove the compound layer that is disclosed in this Patent document is different from the technology of the invention, which comprises two-step treatments, that is, a shot-peening to remove the compound layer and a shot-peening to give compressive residual stress, which are clearly separated from each other.

Further, regarding the treatment of a casting die by nitride, non-patent document 1 contains the following description on pages 103 and 104 in the article that is entitled "4.2.3 The properties that are required of the die for surface treatment."

"Where the surface to be treated has a clear layer of nitride, the surface that is treated by surface treatment has a stress distribution morphology wherein the surface has a buckling, which causes a lowered residual stress to the surface in the treatment-phase, and then has a maximum stress while the buckling is caused by the compressive stress in the layer treated by nitride. Also, if only a little nitride is formed from a gaseous form, the stress distribution morphology shows that the maximum compressive residual stress is measured at the top of the surface, and gradually declines. This shows a typical embodiment of a surface treatment having a gradient function structure where a casting die that is subjected to heat cycles receives just a little change of residual stress caused by the disintegration of the nitride and shows a favorable mild stress gradient in the surface layer even during a heat cycle between heating and cooling. If a thick layer of nitride is formed, a change of tensile stress is observed when the nitride on the surface disintegrates in the heat cycle. So, a die that was treated by nitride and has a thick layer of nitride on the surface is likely to suffer cracks sooner in operation and they are likely to be regarded as defects on the surface of the die. However, no clear expansion or progress of the cracks is observed in the disintegration process nor is there any clear sign of change in the width of the opening of the cracks if the cycles are repeated."

As described above, there is no prior-art document that discloses the subject of removing a compound layer by the treatment of the shot.

Also, there is no established method of evaluating or determining that a compound layer is sufficiently removed for steel products, including a gear or a coil, to say nothing of a method for removing a compound layer of a die. Also, the information as to whether the compound layer is sufficiently removed was not in practical use.

RELATED ART

Patent Documents

Patent Document 1: Publication of Japanese patent application, Publication No. H10-217122

Patent Document 2: Publication of Japanese patent application, Publication No. 2003-191166

Patent Document 3: Publication of Japanese patent application, Publication No. H05-156351

Patent Document 4: Publication of Japanese patent application, Publication No. 2002-166366

Patent Document 5: Publication of Japanese patent application, Publication No. 2006-131922

Non-Patent Documents

Non-Patent Document 1: "Prolongation of Life of Casting die" by Masahiko Hibara, Nikkan Kogyo Shimbun, 2003, pp 103-104

BRIEF DESCRIPTION OF DRAWINGS

FIG. 2 (A) shows one representative example of a pneumatic accelerator of a suctioning-type (gravity-type) and FIG. 2 (B) shows one representative example of a pneumatic accelerator of pressurized-type.

FIG. 3 also shows the eddy current that is in a normal flow and one whose flow is disturbed.

SUMMARY OF INVENTION

Problem to be Solved by Invention

Figure 1:
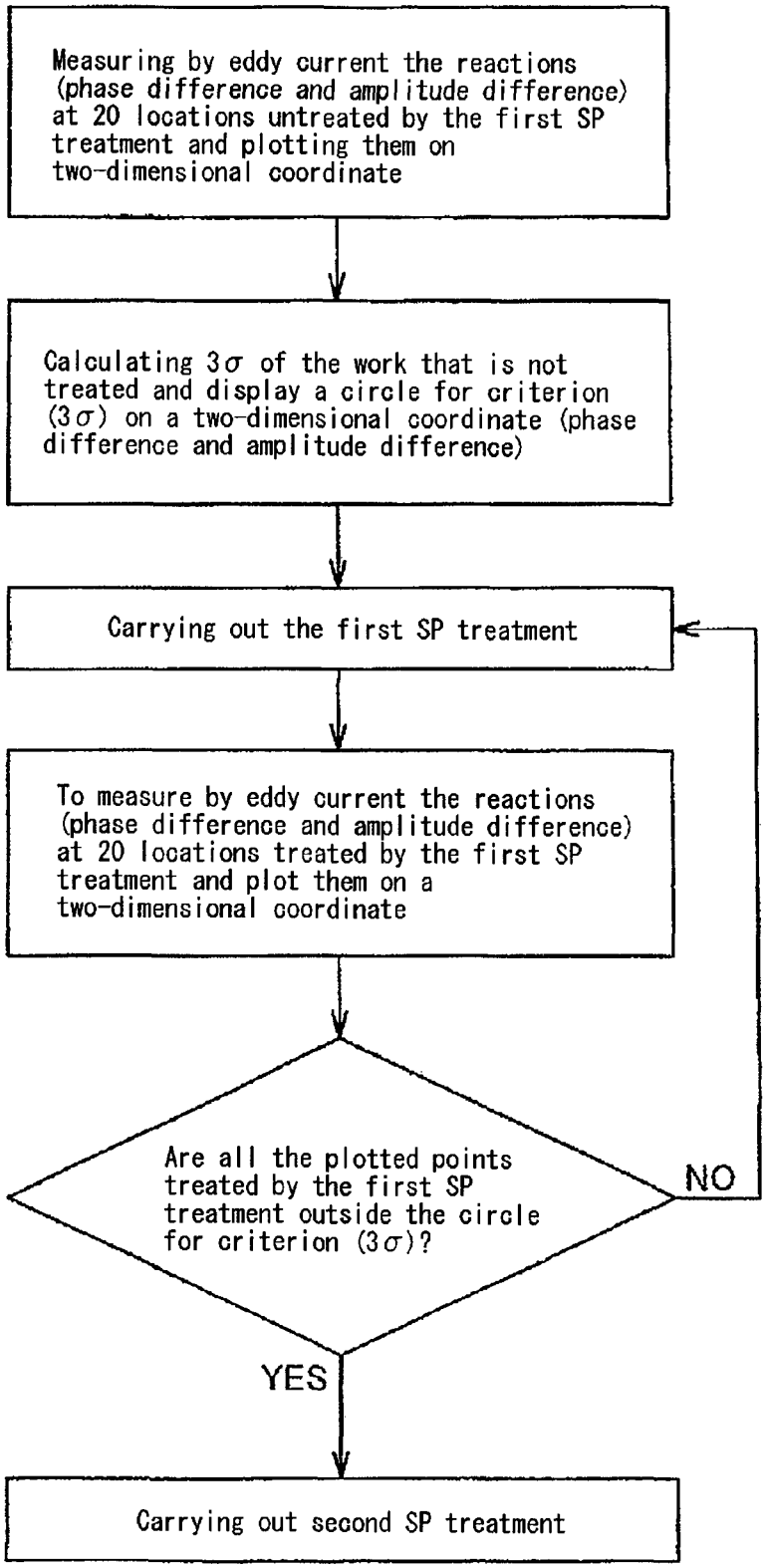
FIG. 1 is a flowchart illustrating the process of the shot-peening treatment.

Recently, to further improve the resistance to thermal stress-cracking (heat check resistance) is needed in casting die, etc.

In view of the above problem, the present invention aims to provide a method of a shot-peening treatment that substantially improves the durability (particularly, heat check resistance) of treated surface of steel products in the process of treating by shot-peening (hereafter, "SP") the surface of a steel product that is the work to be treated and that was treated by heat hardening.

Means to Solve Problem

In treating the casting die, etc., the inventor of the present invention has investigated removing a layer of nitride (compound layer) by shot-peening by using the shots having a great hardness or the particles to be injected having angular shapes (grits) before giving the shot-peening treatment that gives a compressive residual stress to the die.

In studying the effect that the shot-peening gives to the resistance to thermal stress-cracking (heat crack), the inventor found that it is important that the compound layer be sufficiently removed by the first shot-peening (no substantial layer of compound is observed) and achieved the invention of a method of treating steel products by shot-peening that is described below.

The present invention is directed to a method of shot-peening (hereafter, "SP") a work to be treated, which is a steel product that was treated by heat hardening. It comprises the following:

- a first SP treatment that removes a compound layer that was produced by the heat hardening; and
- a second SP treatment that gives compressive residual stress to a first-SP-treated surface that was treated by the first SP treatment;
- wherein the second SP treatment is carried out only on the products that have been proved to be acceptable by a non-destructive inspection and show that the compound layers have been removed from the first-SP-treated surface.

The method of shot-peening the steel product of the present invention can substantially prevent a crack (heat crack) from occurring on the die due to a heat check compared with the conventional method, as is seen in the Examples below. In them, where in the method of shot-peening of the present invention, the steel product is inspected beforehand to see if the compound layer is sufficiently removed by the first SP treatment.

For example, as is seen from the Examples below, even if the first SP treatment were carried out and if the treatment were insufficient, the number of cracks would be as many as about ¼ the number of cracks compared with the number of cracks when no first SP treatment was carried out. In contrast, if the cracks were completely removed by the first SP treatment, the number of cracks would be about 1/30 (see FIG. 10).

As a result, the problem of a heat check (thermal stress-cracking) caused by heat cycles can be prevented in a most stable way.

The products that were rejected may be treated by the first SP treatment at one time after the products that were rejected are collected and subjected to the first SP treatment in one lot. But the products that are rejected can be successively returned to the process of the first SP treatment.

Whether a product passes the test is preferably determined by a non-destructive inspection using an eddy current sensor. The non-destructive inspection using an eddy current sensor has an advantage. It is that all the work to be treated can be tested. Namely, there are two types of testing methods as to whether a compound layer is removed. They are the destructive inspection and the non-destructive inspection. But the destructive inspection is not practical. This is because in actual operation all the products need to be tested, but all products cannot be tested by the destructive inspection. For example, if the hardness is measured, an impression of the measurement will remain on the product.

Further, by the non-destructive inspection being carried out by the eddy current sensor, the number of operations can be reduced and the testing device can be simplified. For example, the non-destructive inspection can include an observation of the composition, which tends to increase the number of processes when the product has as large a size as the die. Also, the inspection by an X-ray requires very large equipment.

In the non-destructive inspection, the compressive residual stress is usually measured. The inventor of the present invention has confirmed and is well aware that the compressive residual stress has no correlation with the ratio of the residual compound layer.

The steel products are not limited to those treated by the nitride, but can be steel products that were treated by the heat hardening, such as carburizing, quenching, etc.

Embodiment for Carrying out Invention

Below the embodiments for carrying out the invention are explained.

In this embodiment, a casting die for a light alloy that is treated by nitride (for example, made of SKD) is taken as an example of the work to be treated namely, a steel product that was heat hardened.

In the present invention, the words "nitride treatment" (or treatment by nitride) mean a heat treatment where an alloy steel that contain at least one of Al, Cr, Mo, Ti, and V is heated in $NH_3$ gas at a low temperature, of about 500° C., to form a very hard layer of nitride on the surface.

Currently the method of treatment by nitride comprises a method of treatment in gas, a salting-in method, and a plasma ion implantation method.

The methods of treatment by nitride greatly differ depending on a method of heating the product and the method of supplying active nitrogen for nitriding.

Unlike carburizing and quenching and unlike induction quenching, the treatment by nitride is characterized in that a layer of iron nitride that hardens the surface of the steel is formed on the surface of steel by the steel being heated in $NH_3$ gas to a temperature of about 500° C. Thereafter it does not need any quenching.

So, the temperature of the treatment by nitride is, unlike the other surface hardening method, at a low temperature, of 500-600° C., such that it has advantages in that the dimensions of the product are least affected directly by a nitride treatment because the treatment is carried out in α-Fe range, and also because a stable compressive stress remains in the top layer of the nitride, which layer gives the product abrasion resistance and fatigue resistance, such that even if the temperature were to rise to close to 600° C., softening would not occur and the product would be relatively stable against heating, and also that it would have relatively good corrosion resistance. So, the treatment by nitride is widely used in industry.

The method of nitriding in gas has a characteristic wherein a diffusion of active nitride forms a layer of diffusion zone of nitride having a high level of hardness on the surface of the steel product.

The layer of nitride is formed by diffusing N into the steel material, which N is produced from reduced $NH_3$ gas according to the following chemical reaction:

$$2NH_3 \leftrightarrows 2N+3H_2$$

The steel absorbs a very small amount of nitrogen in a molecular state ($N_2$), but it is merely as little as 0.0005%. So, the nitrogen in molecular state ($N_2$) does not practically nitride the steel. $NH_3$ is easily reduced at the temperature of the nitride treatment, producing N, which forms the nitride on the steel by being diffused on the steel. Pure iron, carbon steel, or an alloy steel that contains a metal element such as Ni, Co, etc., is not hardened by the nitride treatment. But an alloy steel that contains a metal element such as Al, Cr, Mo, Ti, V, etc., is hardened by the nitride treatment by forming a stable and hardened layer of nitride. That is, an alloy steel having a metal element that combines with N and forms a nitride having a high level of hardness has its hardness greatly increased.

In other words, the method of nitriding does not harden the product by changing the composition of the product, but substantially hardens it by forming a nitride having a high level of hardness. So, there is no need for quenching after being treated by the nitride.

The wording "compound layer (white layer)" refers to a layer that is formed at the position that is closer to the surface than the diffusion zone of nitriding. The layer is mainly made of nitride, carbide, and nitrocarburized material and is very hard and brittle.

As shown in FIG. 1, the SP treatment of the present invention basically comprises the first SP treatment, which removes the compound layer (white layer) and a second SP treatment, which gives compressive residual stress to the first SP treated surface that was treated by the first SP treatment where the second SP treatment is carried out only on the products that have been proved by the non-destructive inspection to show that the compound layers are removed from the first SP treatment.

The wording "the first SP treatment" refers to a treatment wherein the particles to be injected have angular shapes and a high level of hardness (such as alundum or carborundum, grits, cutting wires) or particles of spherical shape to be injected (shots) are used to remove the compound layer (white layer) that is formed on the surface when the nitride treatment is carried out.

If the first SP treatment is carried out to remove the compound layer on the surface, it is necessary to select the hardness of the particles to be injected, the diameters of the particle to be injected, and the speeds of the particles to be injected, so as not to have the diffusion layer that is below the compound layer be removed. For example, the hardness of the particles to be injected should suitably be selected from the following: Vicker's hardness (JISZ2244) HV1200-3000 (preferably HV1700-3000) and grain size number (JISR6001) 20-220 (preferably 30-100). Also, the speeds of the particles to be injected should be suitably selected, for example, from 0.05-1 MPa (preferably 0.1-0.5 MPa), which is an air pressure for injecting, when an pneumatic accelerator is used for injecting these particles.

The wording "the second SP treatment" refers to a treatment by shot-peening that gives compressive residual stress. The shots used in the second SP treatment can be selected from commonly used shots for shot-peening, such as those having a hardness of HV500-1200(preferably HV900-1200) and diameters of the particles of 0.02-1 mm (preferably 0.05-0.2 mm). Also, the speeds of the particles to be injected should be suitably selected, for example, from 0.05-1 MPa (preferably 0.1-0.5 MPa), which is an air pressure for injecting, when a pneumatic accelerator is used for injecting these shots.

Figure 2:
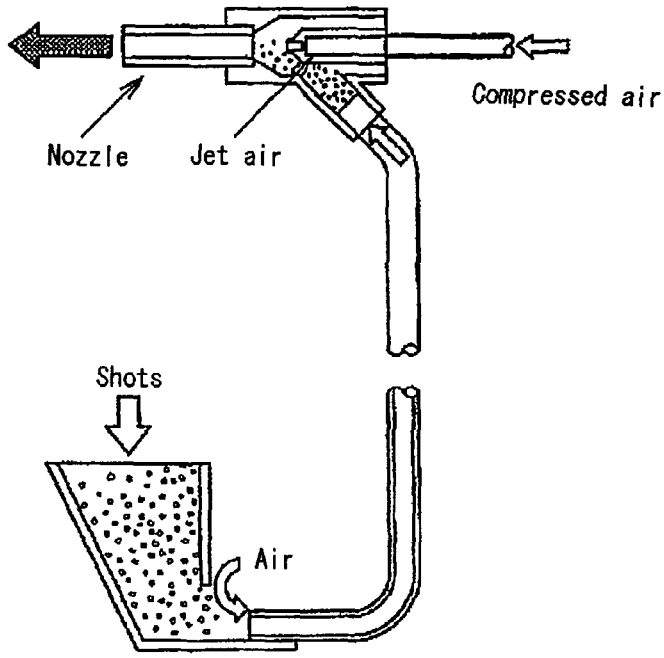
FIG. 2 shows a pneumatic accelerator, an example of the shot-peening apparatus.
Figure 2:
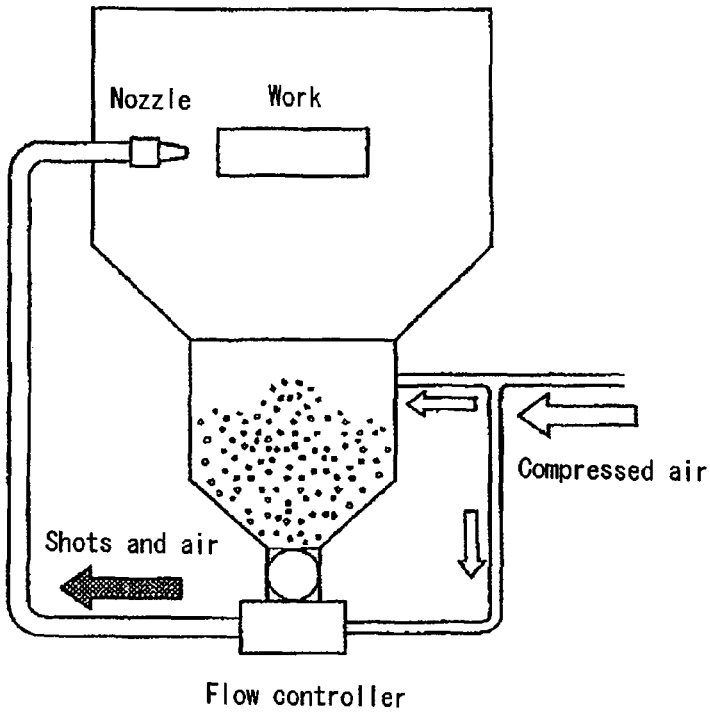

The apparatuses for the SP treatment used for the first SP treatment and the second SP treatment are not limited. For example, a pneumatic accelerator of a suctioning-type (gravity-type) and a pneumatic accelerator of a pressurized-type (direct pressurizing) as shown in FIGS. 2 (A) and (B), or an accelerator of a centrifugal-type (not shown) that injects the particles that are supplied to the impeller that is turning at a high speed, can be used.

Figure 3:
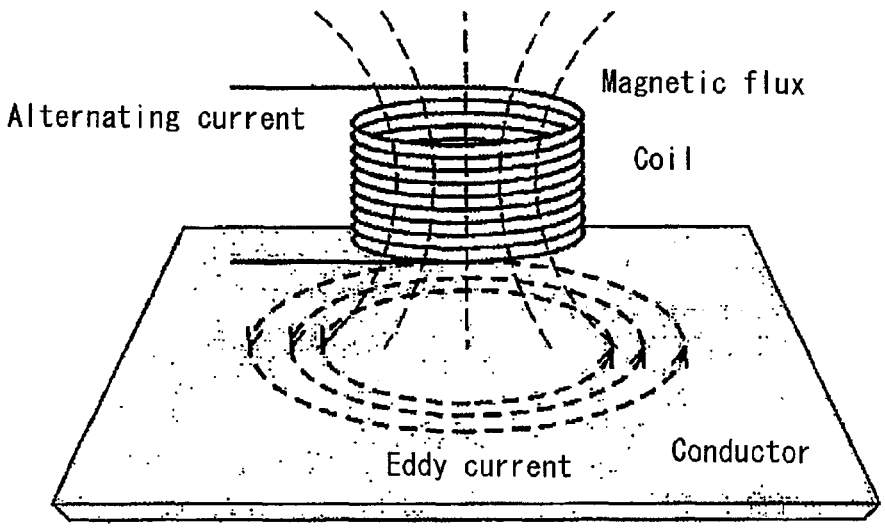
FIG. 3 illustrates one representative example of an eddy current sensor showing how an eddy current is generated.
Figure 3:
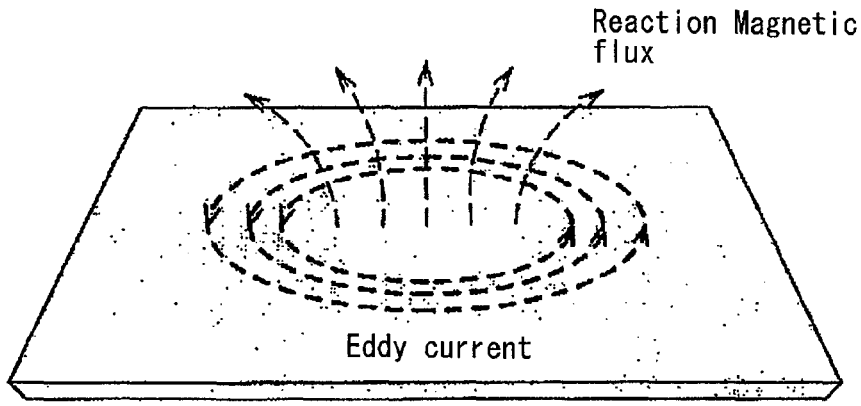
Figure 3:
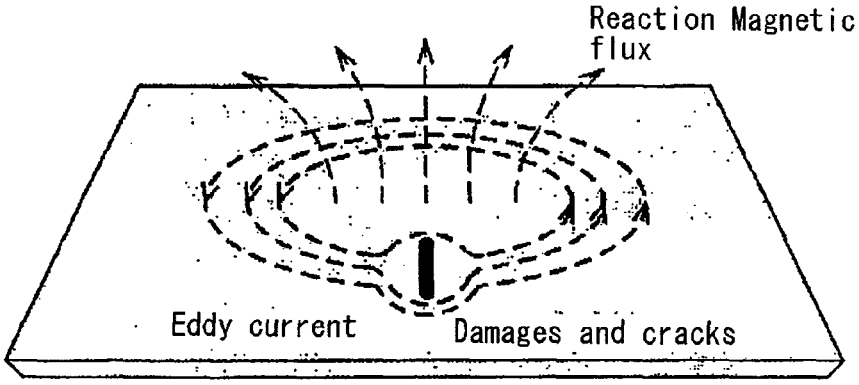
Figure 4:
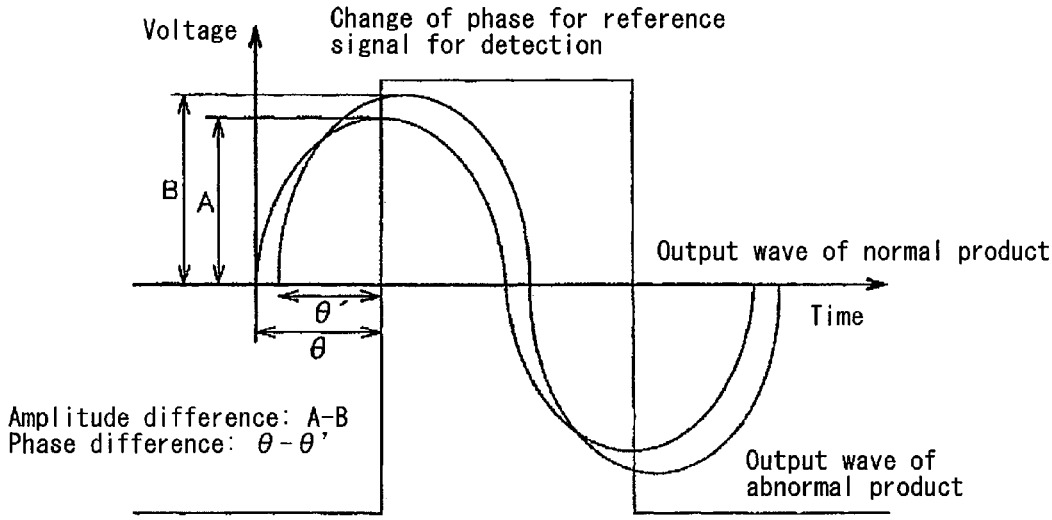
FIG. 4 shows a representative example illustrating waveforms of the eddy current of a normal flow and one whose flow is disturbed and abnormal.

The wording "eddy current" refer to a current in a vortex form that is generated by radiating a AC magnetic flux induction from a coil on the materials (FIG. 3[(A)]). The eddy current generates a magnetic flux that negates the flux produced by the coil (FIG. 3 [B]). If there were any discontinuity in materials that were regarded as abnormal (such as damages, cracks, or distortions), the current would flow while it by-passes the part (FIG. 3[(C)]), which by-passing would not occur if the part is not in any abnormal state. So, if there were any difference in the chemical components or the crystalline structures of the materials from a normal product, the wave profile of the current would be different (FIG. 4). So, by comparing the outputs one can tell if the object that was inspected has received an appropriate treatment (cited from "MDK Sensor" from the home page of Kaisei Engineer Co., Ltd.).

Table 1 gives a list of the elements of the composition of material that affect the conductivity and magnetic permeability and their relationship to the conductivity and magnetic permeability.

TABLE 1

| Conditions of the composition of the material | conductivity | magnetic permeability |
|---|---|---|
| chemical components | ◎ | ○ |
| crystalline structure | X | ◎ |
| structure of the composition | ○ | ○ |
| internal stress | ○ | ◎ |
| fine cracks | ○ | ○ |
| distortion and deformation | X | ○ |
| residual austenite | ○ | ◎ |

In Table 1, the symbol ◎ shows the level of the effect is great. ○ shows that there is an effect. X shows there is scarcely any effect.

As seen from this Table 1, the chemical components greatly affect the conductivity. Also, the crystalline structure, internal stress, and residual austenite greatly affect the magnetic permeability. Namely, from the inspection by the apparatus for eddy current inspection one can tell indirectly the changes in the chemical components, crystalline structure, internal stress, and residual austenite based on the changes in conductivity and magnetic permeability.

So, if the conditions of the composition of the product before it is treated by the first SP treatment is measured at a plurality of points (for example, at 20 points) by the eddy current sensor and also if the conditions of the composition of the product after it is treated by the first SP treatment is measured at a plurality of points (for example, at 20 points) by the eddy current sensor, then the difference (whether a compound layer has been removed) can be evaluated.

That is, whether the compound layer is removed is easily determined by the following (see FIG. 5): to measure both the amplitude difference (voltage) and the phase difference (time) of the current generated from the flux of alternating current at various points of the treated or non-treated work to be treated and to show on the display that is connected to the eddy current sensor via a calculating circuit the results of the measurements where the scopes of the phase difference and the amplitude difference are shown as a circle for the criterion for acceptance where a random variable (vector) X is $\mu-n\sigma<X<\mu+n\sigma$(wherein μ: average value, σ: standard variation, n: 2.5-3.5) and wherein a product is determined to be accepted if all of the plurality of points (each corresponding to the amplitude difference and phase difference of the part that was treated) are plotted outside the circle for the criterion.

Namely, if all of the plurality of points that are measured are shown outside the circle for criterion, it will be determined that the conditions of the composition of the product are different from those of the compound layer (i.e., the compound layer is completely removed). The expectation values (P: probability interval) where the compound layer is contained within the circle for the criterion are, for each of n=2.5, 3, and 3.5, the following:

$$P(\mu-2.5\sigma<X<\mu+2.5\sigma)=0.9879$$

$$P(\mu-3\sigma<X<\mu+3\sigma)=0.9973$$

$$P(\mu-3.5\sigma<X<\mu+3.5\sigma)=0.9996$$

So, to avoid any incorrect judgment, to use the circle for criterion where n=3 is most preferable. But any circle for criterion where random variable X is selected from n=2.5 to 3.5 can be used.

Shot-Peening System

Figure 6:
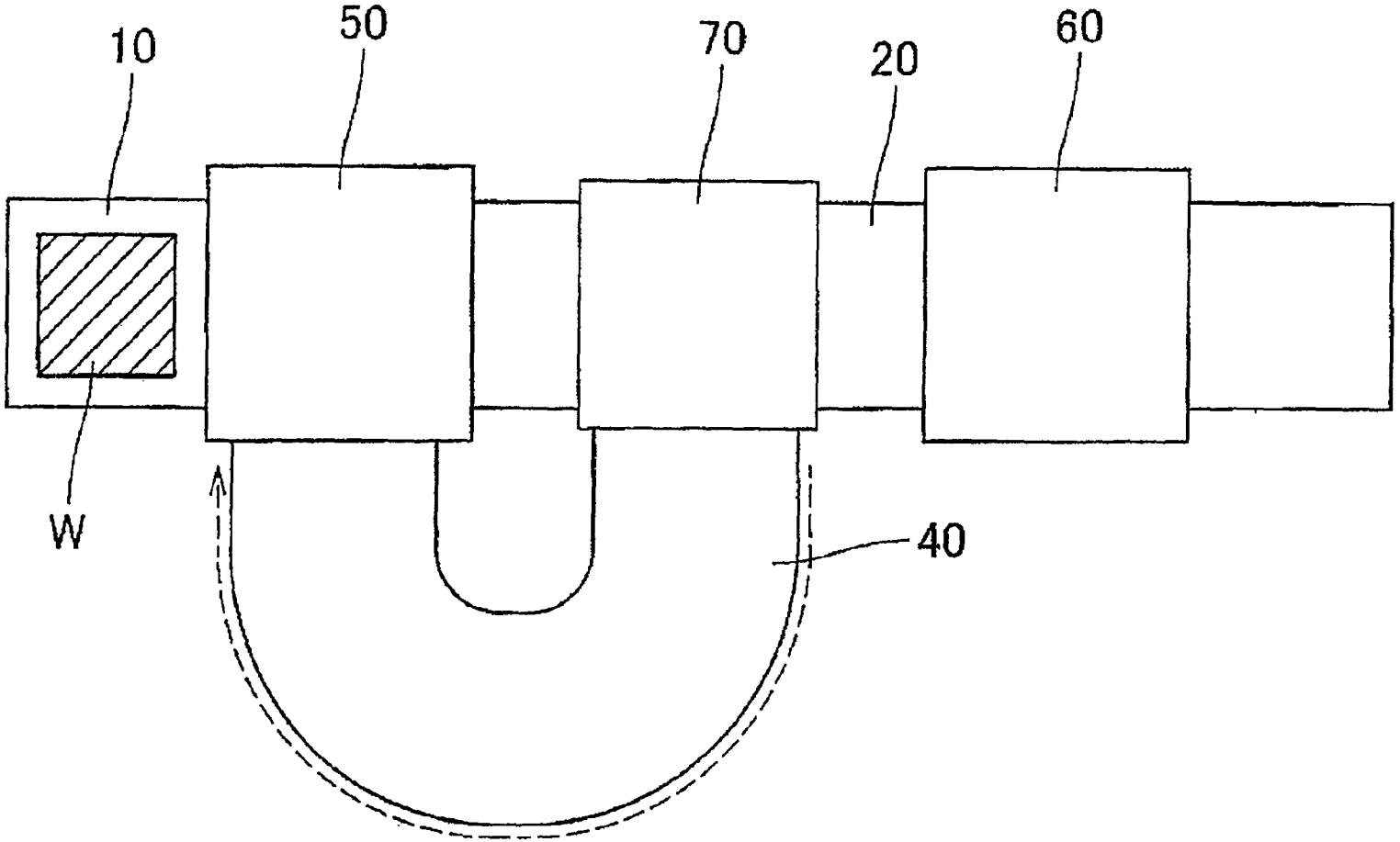
FIG. 6 is a plane view of a shot-peening treatment system of one embodiment of the present invention.
Figure 7:
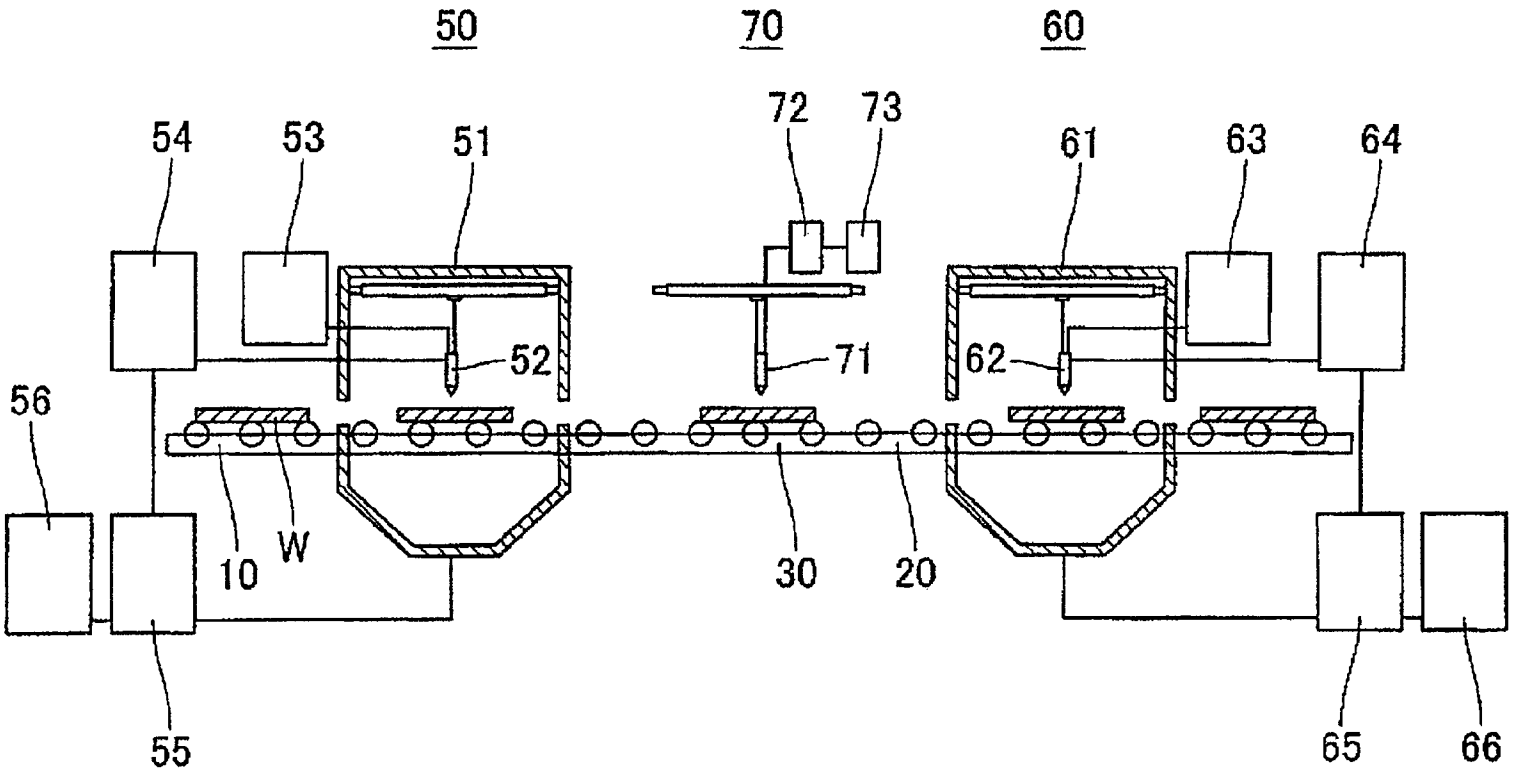
FIG. 7 is a front view of the shot-peening treatment system of FIG. 6.

FIGS. 6 and 7 show an example of an SP treatment system of a product of a steel material. The work to be treated (Work) W is transported by a first transporting apparatus 10 to the inside of a first SP treatment chamber 51 of the first SP treatment apparatus 50 where the first SP treatment is carried out by a injecting nozzle 52 injecting the particles to be injected.

The work to be treated W that is treated with the first SP treatment is transported by the first transporting apparatus 10 from the first SP treatment apparatus 50 to an apparatus to determine if the product is acceptable 70, which apparatus determines if the compound layer on the surface of the work to be treated W is appropriately removed.

The apparatus to determine if the product is acceptable 70, has a probe (contact point) 71 and an analyzing device 72. The surface conditions of the work to be treated are measured by the probe 71. If it is determined that the compound layer on the surface of the work to be treated has been appropriately removed, the work to be treated is transported by a second transporting apparatus 20 to the inside of a second SP treatment chamber 61 of the second SP treatment apparatus 60 where the second SP treatment is carried out by a injecting nozzle 62 injecting the particles to be injected. After the second SP treatment is completed, the work to be treated is transported by a second transporting apparatus 20 from the second SP treatment apparatus 60 to the predetermined location where the works to be treated accumulate. Thus a sequence of a shot-peening treatment is complete.

Meanwhile, "the work that was rejected" because the compound layer on the surface of the work to be treated W is not appropriately removed is diverted by an apparatus for sorting 30 to an apparatus for transporting the work that is rejected 40 according to the signal received from an apparatus for controlling the apparatus for sorting 73. The apparatus for transporting the work that is rejected 40 then transports the work to be treated that was rejected, to the first SP treatment apparatus 50 where the first SP treatment is carried out. The work to be treated W that is again treated with the first SP treatment is inspected by the apparatus to determine if the product is acceptable 70, as seen above. If the work to be treated W is found acceptable, it is treated with the second SP treatment. Then the cycle of the shot-peening treatment is complete.

The injecting nozzles 52, 62 are connected to apparatuses for supplying compressed air 53, 63, respectively. Also, hoppers for particles to be injected 54, 64 are connected to the injecting nozzles 52, 62, respectively, so as to enable the particles to be injected to be supplied from the hoppers. Further, classifiers 55, 65, are disposed to have the particles to be injected recycled via the classifiers 55, 65, to the hoppers for particles to be injected 54, 64, respectively, for their partial reuse. Numerals 56, 66 denote dust collectors.

The shot-peening system is not limited to those systems shown in FIGS. 6 and 7. It can be suitably modified within the scope of the present invention.

For example, the works to be treated W that are rejected by the apparatus to determine if the product is acceptable 70 are not directly transported to the first SP treatment apparatus 50 but can be stocked at a certain location. If the works to be treated W that are rejected accumulate in some quantity, they can be treated with the first SP treatment. The first SP treatment apparatus can also work as the second SP treatment apparatus.

EXAMPLES

The present invention is explained in detail based on examples (verification tests as to whether the compound layer is removed).

A test sample made of SKD 61 material (diameter 15 mm×height 20 mm) was used after it was treated by nitride-gas (the thickness of the compound layer: 5 μm).

The conditions of the first SP treatment and the second SP treatment are shown in Table 2.

TABLE 2

| | Particle to be injected | Diameter of particles to be injected μm | Hardness of particle to be injected Hv | Air pressure for injecting MPa |
|---|---|---|---|---|
| the first SP | molten alumina | 326 | 2200 | 0.3 |
| the second SP | iron-based | 50 | 900 | 0.45 |

As the apparatus for eddy current inspection, "Magna-TestD HF Probe" (Foerster Japan Ltd.) was used.

In the first SP treatment, the particles to be injected in the examples were injected at 0.56 kg/min for 30 seconds. In the comparative examples, they were injected in the same amount for 15 seconds.

The changes of the composition were measured for the work that is not treated; for the work to be treated that was treated by the first SP treatment of the comparative examples; and for the work to be treated that was treated by the first SP treatment of the examples, by means of the apparatus for eddy current inspection, where the changes of the composition were measured each at 20 locations (pitch of the measurement: 5-10 mm) using an eddy current. The results of the measurements are shown on the two-dimensional coordinate, each coordinate representing the phase difference (time) and voltage. Then the standard variation (σ) is calculated and the circle for criterion for acceptance that corresponds to the X, which is $\mu-3\sigma<X<\mu+3\sigma$, is shown as given in FIG. 5.

So, by these tests it is possible to clearly see whether a compound layer is removed.

Whether the compound layer of the nitride is removed and the effect that the shot-peening gives on occurrence of cracks due to heat-stress fatigue is tested by carrying out the heat check tests.

Figure 8:
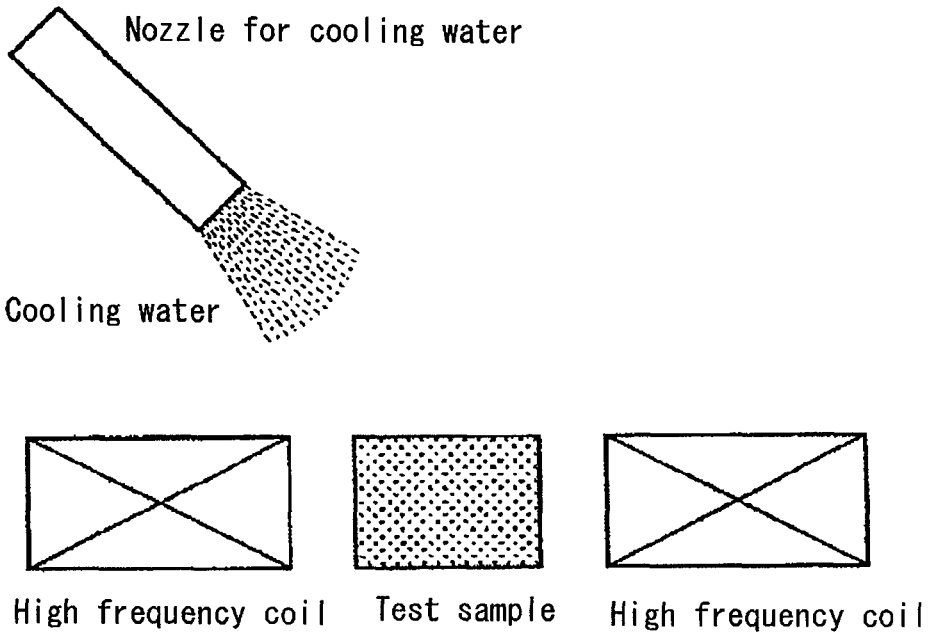
FIG. 8 is one representative example showing how heat check resistance is tested.
Figure 9:
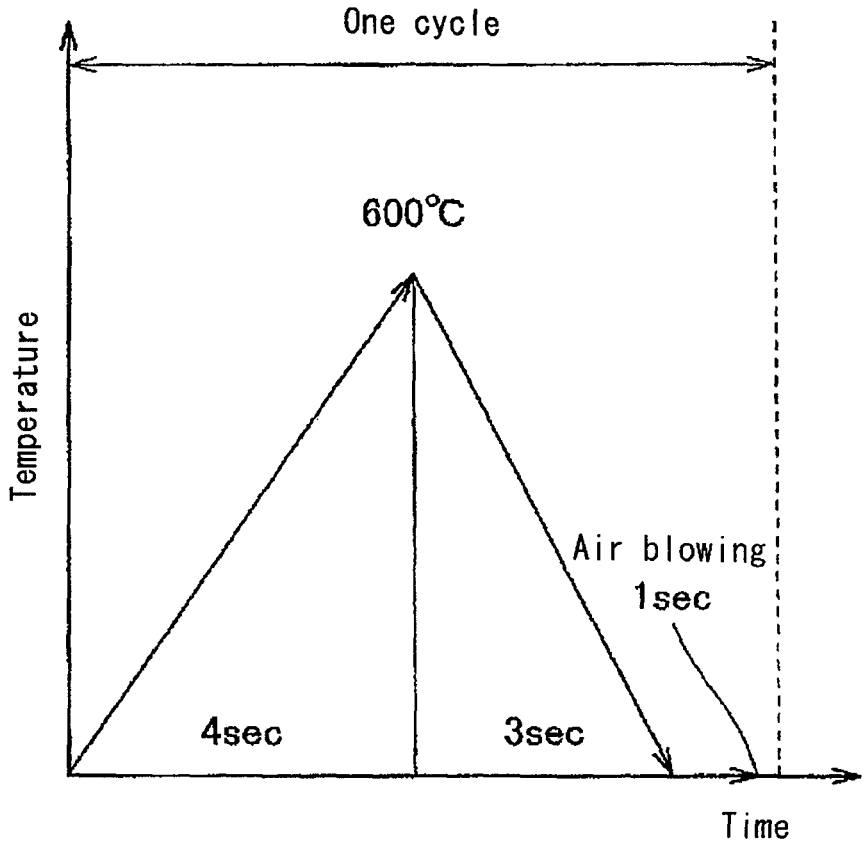
FIG. 9 shows one representative example illustrating a heat cycle applied to the test in FIG. 8.

The heat check test refers to a test simulating the conditions for the heat fatigue of a casting die that is repeatedly heated by molten aluminum and cooled by a parting agent. The heat check test evaluates cracks that appear on the test samples that have undergone predetermined cycles of the heating by a high-frequency coil and cooling by water within a short period. FIG. 8 gives a conceptual illustration of the heat check test and FIG. 9 shows a heating- and -cooling cycle pattern.

The heat check tests were carried out on the following samples 1), 2) and 3) and the number of cracks that appear of the samples were determined after 10,000 cycles of the heat fatigues are carried out:

1) as nitride-treated (having a compound layer of 5-10 μm thick);
2) the first SP treatment (the compound layer is insufficiently removed: see comparative example [0070])+the second SP treatment; and
3) the first SP treatment (see the example)+the second SP treatment.

Figure 10:
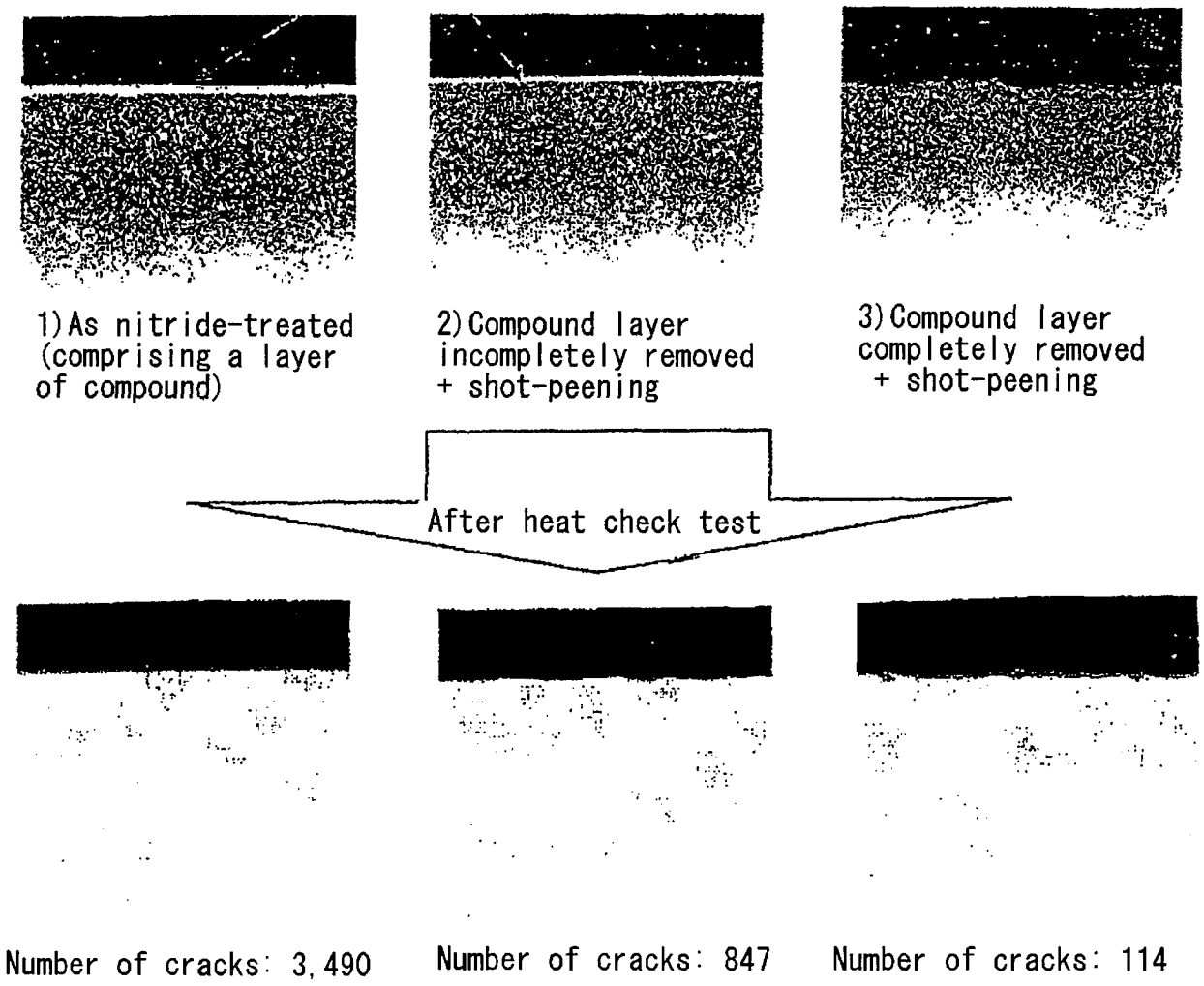
FIG. 10 shows cross-sectional photographs showing the results of the tests of heat check resistance.

The samples with a larger number of cracks have an inferior heat fatigue resistance. FIG. 10 shows the results of the heat check tests.

FIG. 10 shows that the samples that are treated just as those samples that are treated as nitride-treated have 3,490 cracks after they are tested for the heat check. From FIG. 10, it is seen that if the samples are treated by the shot-peening the number of cracks are reduced. If the shot-peening is carried out after the compound layer is completely removed, a better result is obtained.

Figure 5:
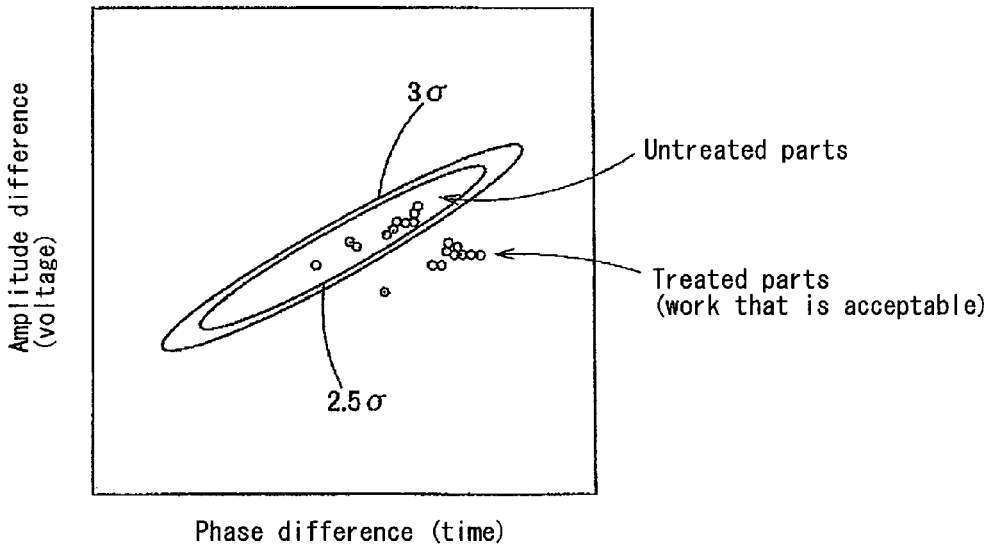
FIG. 5 shows a representative example illustrating circles $3\sigma$ and $2.5\sigma$ that determine, by the apparatus for eddy current inspection for detecting, whether the compound layer is removed.

Next, the results of the heat check tests where the circle for the criterion for acceptance that correspond to the scope given by $\mu-2.5\sigma<X<\mu+2.5\sigma$ is used are investigated. As shown in FIG. 5, the parts of the work that were not treated were not wrongly assessed as the parts of the work that were treated. From this fact, one can suitably select n, from within the range of n=2.5-3, as the circles for the criterion for acceptance that are shown by $\mu-n\sigma<X<\mu+n\sigma$, where X is a random variable, considering the required strength and required accuracy for a gear and spring even when the shot-peening is applied to a steel product such as not only a die but the gear and spring.

The basic Japanese Patent Application, No. 2009-227935, filed Sep. 30, 2009, is hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skill in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

The invention claimed is:

1. A method of shot-peening (hereafter, "SP") a work to be treated, which work is a steel product that was subject to heat hardening, comprising:

performing a first SP treatment that removes a compound layer that was produced by the heat hardening;

determining whether the product of the first SP treatment is acceptable;

performing a second SP treatment that gives compressive residual stress to a first-SP-treated surface that was treated by the first SP treatment;

wherein the second SP treatment is carried out only on the products that have been proved to be acceptable by a non-destructive inspection and show that the compound layer has been removed from the first-SP-treated surface;

wherein determining whether the products have been proved to be acceptable by a non-destructive inspection and show that the compound layers has been removed from the first-SP-treated surface is performed by the nondestructive inspection using an eddy current sensor;

wherein the product is determined to be acceptable by the following: first to measure by the eddy current sensor both phase difference in time and amplitude difference in voltage of a current generated from a flux of alternating current at various points of a non-treated work or of the parts of the treated work where the compound layers have not been removed and to enter the results of measurements by the eddy current sensor into a display circuit that is connected to the eddy current sensor via a calculating circuit where the scopes of the phase difference and the amplitude difference are shown as a circle for the criterion for acceptance where a random variable in vector X is $\mu-n\sigma<X<\mu+n\sigma$, wherein $\mu$ is an average value, $\sigma$ is a standard variation, and n is 2.5-3.5, and wherein the product is determined to be acceptable if all of a plurality of points are plotted outside the circle for criterion, wherein each point corresponds to the phase difference and amplitude difference of the part that was treated in the first SP treatment, and wherein the product that is not determined to be acceptable is rejected.

2. The method of shot-peening a work to be treated, of claim 1, wherein the products that were rejected are returned to the first SP treatment.

3. The method of shot-peening a work to be treated, of claim 1, wherein the scopes of the phase difference and the amplitude difference are shown as a circle for the criterion where a random variable in vector X is $\mu-3\sigma<X<\mu+3\sigma$.

4. The method of shot-peening a work to be treated according to any one of claims 1, 2, and 3, wherein the steel product that was heat hardened is a steel product that comprises at least one of Al, Cr, Mo, Ti, and V and that is treated by nitride.

5. The method of shot-peening a work to be treated, of claim 3, wherein the steel product is a casting die for light alloys.

6. A shot-peening system used for a method of shot-peening (hereafter, "SP") a work to be treated, which work is a steel product that was subjected to heat hardening, the system comprising:

a first SP treatment apparatus used for a first SP treatment that removes a compound layer that was produced by the heat hardening; and a second SP treatment apparatus used for a second SP treatment that gives compressive residual stress to the first-SP-treated surface that was treated by the first SP treatment;

an apparatus to determine if the product is acceptable as to whether the compound layer is removed from the first-SP-treated surface wherein the apparatus determines whether the products have been proved to be acceptable by a non-destructive inspection and show that the compound layer has been removed from the first-SP-treated surface by the non-destructive inspection using an eddy current sensor;

wherein the apparatus to determine determines the product to be acceptable by the following: the eddy current sensor to measure both phase difference in time and amplitude difference in voltage of a current generated from a flux of alternating current at various points of a non-treated work or of the parts of the treated work where the compound layers have not been removed and to enter the results of measurements by the eddy current sensor into a display circuit that is connected to the eddy current sensor via a calculating circuit where the scopes of the phase difference and the amplitude difference are shown as a circle for the criterion for acceptance where a random variable in vector X is $\mu-n\sigma<X<\mu+n\sigma$, wherein $\mu$ is an average value, $\sigma$ is a standard variation, and n is 2.5-3.5, and wherein the product is determined to be acceptable if all of a plurality of points are plotted outside the circle for the criterion, wherein each point corresponds to the phase difference and amplitude difference of the part that was treated in the first SP treatment, and wherein the product that is not determined to be acceptable is rejected;

an apparatus for transporting the work to be treated transports the work to be treated the second SP treatment apparatus if the apparatus to determine if the product is acceptable determines the work to be treated is acceptable; and an apparatus for transporting the work that is rejected transports the work that is rejected to the first SP treatment apparatus if the work to be treated is not acceptable.

* * * * *

UNITED STATES PATENT AND TRADEMARK OFFICE

CERTIFICATE OF CORRECTION

PATENT NO. : 9,056,386 B2
APPLICATION NO. : 13/498453
DATED : June 16, 2015
INVENTOR(S) : Yuji Kobayashi It is certified that error appears in the above-identified patent and that said Letters Patent is hereby corrected as shown below:

Claims

Claim 6, col. 12, lines 45-46, "transports the work to be treated the second SP treatment apparatus" should read --transports the work to be treated to the second SP treatment apparatus--.

Signed and Sealed this
Twelfth Day of April, 2016

Michelle K. Lee

Michelle K. Lee
*Director of the United States Patent and Trademark Office*